US009151131B2

(12) United States Patent
Drablier et al.

(10) Patent No.: US 9,151,131 B2
(45) Date of Patent: Oct. 6, 2015

(54) POWER AND CONTROL POD FOR A SUBSEA ARTIFICIAL LIFT SYSTEM

(75) Inventors: Didier Drablier, Hinton, OK (US); Neil Griffiths, Houston, TX (US); Eugene Bespalov, Paris (FR)

(73) Assignee: Zeitecs B.V., Rijswijk (NL)

( * ) Notice: Subject to any disclaimer, the term of this patent is extended or adjusted under 35 U.S.C. 154(b) by 559 days.

(21) Appl. No.: 13/562,454

(22) Filed: Jul. 31, 2012

(65) Prior Publication Data

US 2013/0043034 A1 Feb. 21, 2013

Related U.S. Application Data

(60) Provisional application No. 61/524,087, filed on Aug. 16, 2011.

(51) Int. Cl.
*E21B 33/035* (2006.01)
*E21B 43/12* (2006.01)

(52) U.S. Cl.
CPC ..... *E21B 33/0355* (2013.01); *E21B 43/128* (2013.01)

(58) Field of Classification Search
CPC ..... E21B 33/0355; E21B 43/128
USPC ..... 166/338, 351, 368, 65.1, 68, 105; 307/151; 340/853.1, 853.3, 854.9
See application file for complete search history.

(56) References Cited

U.S. PATENT DOCUMENTS 3,638,732 A * 2/1972 Huntsinger et al. ..... 166/379
4,491,176 A * 1/1985 Reed ..... 166/66.4
4,639,714 A * 1/1987 Crowe ..... 375/259
5,086,196 A 2/1992 Brookbank et al.
5,280,766 A * 1/1994 Mohn ..... 166/368
5,558,532 A * 9/1996 Hopper ..... 439/310
6,053,253 A * 4/2000 Nicholson ..... 166/368
6,415,869 B1 7/2002 Smith
6,508,308 B1 * 1/2003 Shaw ..... 166/313
6,557,642 B2 5/2003 Head
6,681,861 B2 * 1/2004 Davidson et al. ..... 166/382
7,011,152 B2 * 3/2006 Soelvik ..... 166/65.1
7,225,876 B2 * 6/2007 Laureano ..... 166/343
7,360,601 B2 4/2008 See
7,576,447 B2 8/2009 Biester et al.
7,615,893 B2 * 11/2009 Biester et al. ..... 307/82
7,677,320 B2 * 3/2010 Shaw et al. ..... 166/368
8,534,366 B2 * 9/2013 Fielder et al. ..... 166/378
8,727,016 B2 * 5/2014 Noui-Mehidi et al. ..... 166/369
2003/0102720 A1 * 6/2003 Baggs et al. ..... 307/149
2010/0133901 A1 * 6/2010 Zhang et al. ..... 307/11

(Continued)

OTHER PUBLICATIONS

"Production Systems: CameronDC by Cameron" article dated May 1, 2009, http://www.epmag.com/article/print/37613, 2 pages.

(Continued)

*Primary Examiner* — Matthew Buck
(74) *Attorney, Agent, or Firm* — Patterson & Sheridan, L.L.P.

(57) ABSTRACT

Embodiments of the present invention generally relate to a power and control pod for subsea artificial lift system. In one embodiment, a method of operating a downhole tool in a subsea wellbore includes: supplying a direct current (DC) power signal from a dry location to a subsea control pod; converting the DC power signal to an alternating current (AC) power signal by the control pod; and supplying the AC power signal from the control pod, into the subsea wellbore, and to the downhole tool.

16 Claims, 6 Drawing Sheets

(56) References Cited

U.S. PATENT DOCUMENTS

| | | | | |
|---|---|---|---|---|
| 2010/0288501 | A1* | 11/2010 | Fielder et al. | 166/311 |
| 2011/0024104 | A1 | 2/2011 | Griffiths | |
| 2011/0247825 | A1* | 10/2011 | Batho et al. | 166/335 |
| 2011/0251728 | A1* | 10/2011 | Batho et al. | 700/282 |
| 2011/0300008 | A1 | 12/2011 | Fielder et al. | |
| 2012/0001482 | A1* | 1/2012 | Burdick | 307/9.1 |
| 2012/0210926 | A1 | 8/2012 | Storm, Jr. et al. | |
| 2012/0292051 | A1 | 11/2012 | Wetzel et al. | |

OTHER PUBLICATIONS

VetcoGray, a GE Oil & Gas business—"Subsea Production Systems" presentation, Subsea Forum—Young Engineers Day, Paris, Jun. 13, 2007, 27 pages.

* cited by examiner

POWER AND CONTROL POD FOR A SUBSEA ARTIFICIAL LIFT SYSTEM

CROSS-REFERENCE TO RELATED APPLICATIONS

This application claims benefit of U.S. provisional patent application Ser. No. 61/524,087, filed Aug. 16, 2011, which is herein incorporated by reference.

BACKGROUND OF THE INVENTION

1. Field of the Invention

Embodiments of the present invention generally relate to a power and control pod for subsea artificial lift system.

2. Description of the Related Art

The oil industry has utilized electric submersible pumps (ESPs) to produce high flow-rate wells for decades, the materials and design of these pumps has increased the ability of the system to survive for longer periods of time without intervention. These systems are typically deployed on the tubing string with the power cable fastened to the tubing by mechanical devices such as metal bands or metal cable protectors. Well intervention to replace the equipment requires the operator to pull the tubing string and power cable requiring a well servicing rig and special spooler to spool the cable safely. The industry has tried to find viable alternatives to this deployment method especially in offshore and remote locations where the cost increases significantly. There has been limited deployment of cable inserted in coil tubing where the coiled tubing is utilized to support the weight of the equipment and cable, although this system is seen as an improvement over jointed tubing the cost, reliability and availability of coiled tubing units have prohibited use on a broader basis. Current intervention methods of deployment and retrieval of submersible pumps require well control by injecting heavy weight (a.k.a. kill) fluid in the wellbore to neutralize the flowing pressure thus reducing the chance of lose of well control.

SUMMARY OF THE INVENTION

Embodiments of the present invention generally relate to a power and control pod for subsea artificial lift system. In one embodiment, a method of operating a downhole tool in a subsea wellbore includes: supplying a direct current (DC) power signal from a dry location to a subsea control pod; converting the DC power signal to an alternating current (AC) power signal by the control pod; and supplying the AC power signal from the control pod, into the subsea wellbore, and to the downhole tool.

In another embodiment, a subsea control pod for an artificial lift system (ALS) includes: a cablehead for receiving an umbilical; a diplexer for separating a composite signal received by the umbilical into a DC power signal and a command signal; a power converter, including: a power supply for reducing voltage of the DC power signal from medium to low; and a motor controller for receiving an output signal of the power supply and supplying a three phase power signal to an electric submersible pump (ESP); and a subsea interface for connection to a subsea production tree.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
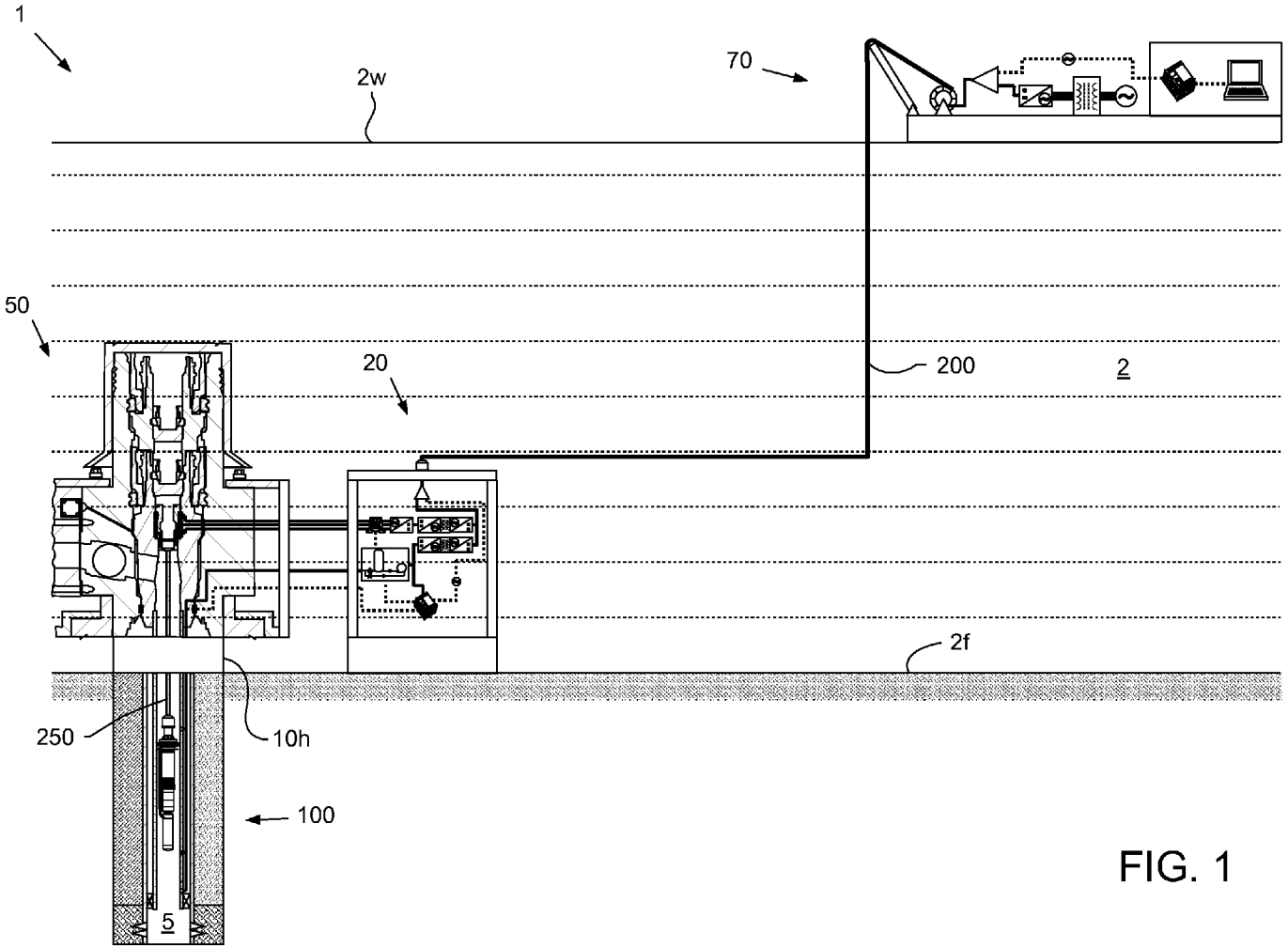
FIG. 1 illustrates a subsea artificial lift system (ALS), according to one embodiment of the present invention.

FIG. 1 illustrates a subsea artificial lift system (ALS) 1, according to one embodiment of the present invention. The ALS 1 may include an electric submersible pump (ESP) 100, a deployment cable 250, a subsea production (aka Christmas) tree 50, a subsea control pod 20, an umbilical 200, and a launch and recovery system (LARS) 70. A length of the umbilical 200 may include a vertical depth portion and a horizontal step-out portion. The umbilical length may be greater than, equal to, or substantially greater than five hundred feet, such as one-quarter, one-half, three-quarters, one, two, or five miles.

Figure 2B:
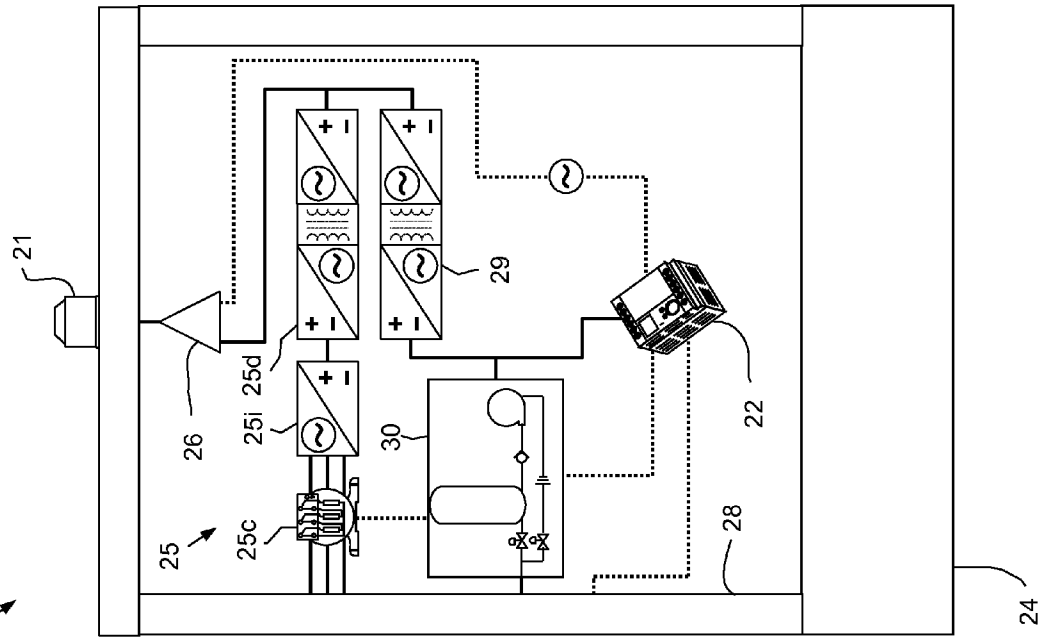
FIG. 2B illustrates a control pod of the ALS.
Figure 2A:
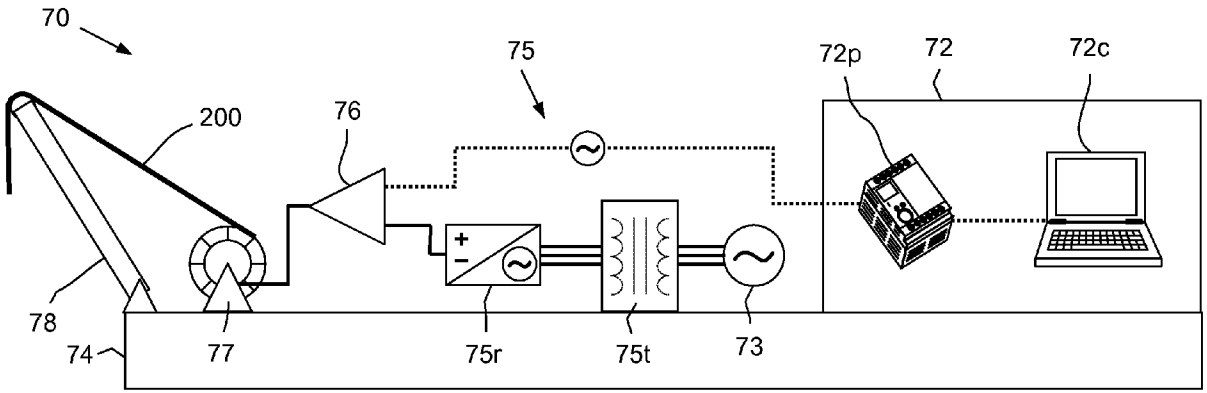
FIG. 2A illustrates a launch and recovery system (LARS) of the ALS.

FIG. 2A illustrates the LARS 70. The pod 20 may be launched into the sea 2 from a support vessel (not shown) by the LARS 70. Once deployed, the LARS 70 may be transported and loaded onto a control platform (not shown). The control platform may have personnel stationed onboard or be automated. If automated, the control platform may be in communication with an onshore command center, such as by a satellite transceiver (not shown). Alternatively, the LARS 70 may be located on any other dry location, such as on a production platform or onshore. The control pod 20 may be controlled and supplied with power by the LARS 70. The LARS 70 may include a control van 72, a generator 73, a skid frame 74, a power converter 75, a diplexer (DIX) 76, a winch 77 having the umbilical 200 wrapped therearound, and a boom 78. The control van 72 may include a control console 72*c* and a programmable logic controller (PLC) 72*p*.

The generator 73 may be diesel-powered and may supply a one or more phase (three shown) alternating current (AC) power signal to the power converter 75. The power converter 75 may include a one or more (three shown) phase transformer 75*t* for stepping the voltage of the AC power signal supplied by the generator 73 from a low voltage signal to a medium voltage signal. The low voltage signal may be less than or equal to one kilovolt (kV) and the medium voltage signal may be greater than one kV, such as five to ten kV. The power converter 75 may further include a one or more (three shown) phase rectifier 75*r* for converting the medium voltage AC signal supplied by the transformer 75*t* to a medium voltage direct current (DC) power signal. The rectifier 75*r* may supply the medium voltage DC power signal to the DIX 76 for transmission to the control pod 20 via the umbilical 200.

Alternatively, the generator 73 may be omitted and the power converter 75 may receive the power signal from a generator of the platform instead. Additionally, the LARS 70 may include a second power converter (not shown) for powering the control van 72.

The PLC 72*p* may receive commands from a control van operator (not shown) via the control console 72*c* and include a data modem (not shown) and multiplexer (not shown) for modulating and multiplexing the commands into a data signal for delivery to the DIX 76 and transmission to the pod 20 via the umbilical 200. The DIX 76 may combine the DC power signal and the data signal into a composite signal and transmit the composite signal to the pod 20 via the umbilical 200. The DIX 76 may be in electrical communication with the umbilical 200 via an electrical coupling (not shown), such as brushes or slip rings, to allow power and data transmission through the umbilical while the winch 77 winds and unwinds the umbilical. The control console 72*c* may include one or more input devices, such as a keyboard and mouse or trackpad, and one or more video monitors. Alternatively, a touchscreen may be used instead of the monitor and input devices. The PLC 72*p* may also receive data signals from the pod 20, demodulate and demultiplex the data signals, and display the data signals on the monitor of the console 72*c*.

The boom 78 may be an A-frame pivoted to the frame 74 and the LARS 70 may further include a boom hoist (not shown) having a pair of piston and cylinder assemblies (PCAs). Each PCA may be pivoted to each beam of the boom and a respective column of the frame. The LARS may further include a hydraulic power unit (HPU) (not shown). The HPU may include a hydraulic fluid reservoir, a hydraulic pump, an accumulator, and one or more control valves for selectively providing fluid communication between the reservoir, the accumulator, and the PCAs. The hydraulic pump may be driven by an electric motor. The winch 77 may include a drum having the umbilical 200 wrapped therearound and a motor for rotating the drum to wind and unwind the umbilical. The winch motor may be electric or hydraulic. A sheave (not shown) may hang from the boom 78. The umbilical 200 may extend through the sheave and an end of the umbilical may be fastened to a cablehead 21 (FIG. 2B) of the pod 20. The frame 74 may have a platform (not shown) for the pod 20. Pivoting of the A-frame boom relative to the support vessel by the PCAs may lift the pod 20 from the platform, over a rail of the vessel, and to a position over the waterline 2*w*. The winch 77 may then be operated to lower the pod 20 into the sea 2. Recovery of the pod 20 may be performed by reversing the steps.

Figure 3A:
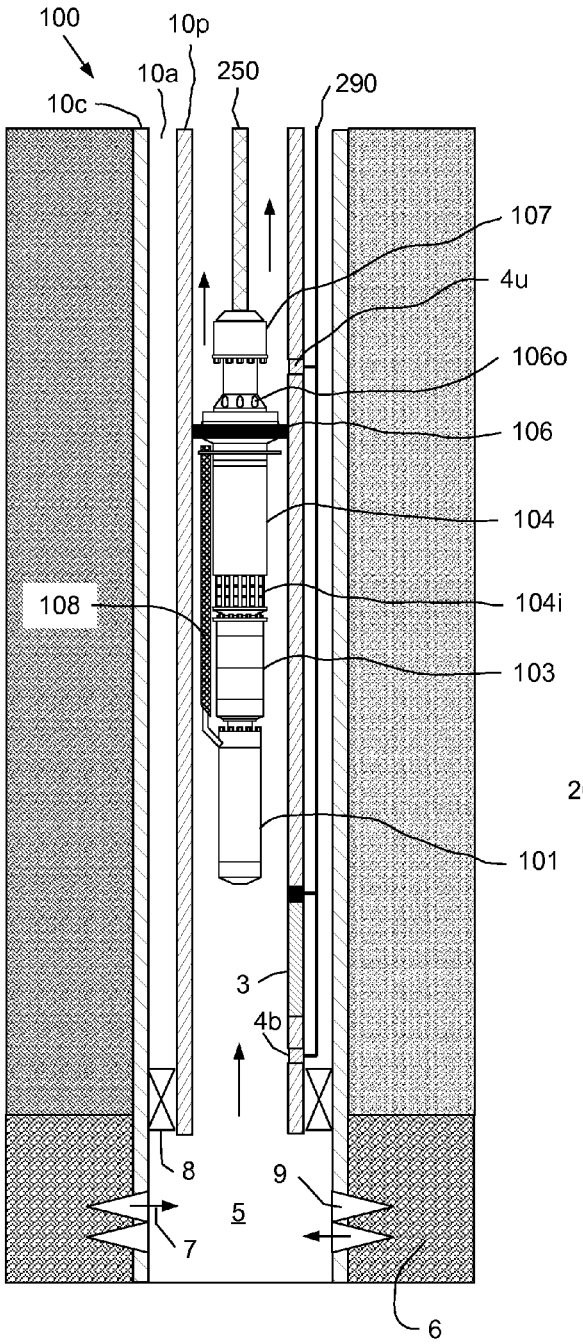
FIG. 3A illustrates a cable deployed electric submersible pump (ESP) of the ALS.
Figure 3B:
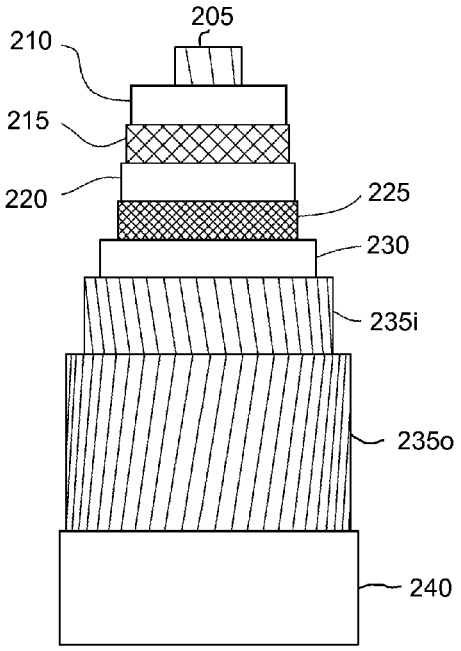
FIGS. 3B and 3C illustrate an umbilical of the ALS.
Figure 3C:
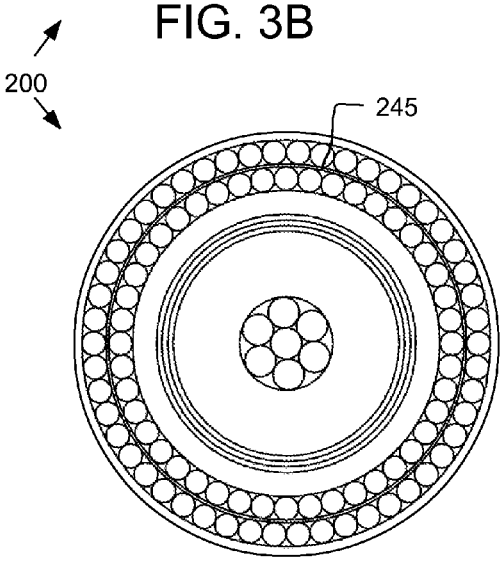

FIGS. 3B and 3C illustrate the umbilical 200. The umbilical 200 may include an inner core 205, an inner jacket 210, a shield 215, an outer jacket 230, one or more layers 235*i,o* of armor, and a cover 240. Alternatively, the cover 240 may be omitted.

The inner core 205 may be the first conductor and made from an electrically conductive material, such as aluminum, copper, or alloys thereof. The inner core 205 may be solid or stranded. The inner jacket 210 may electrically isolate the core 205 from the shield 215 and be made from a dielectric material, such as a polymer (i.e., polyethylene). The shield 215 may serve as the second conductor and be made from the electrically conductive material. The shield 215 may be tubular, braided, or a foil covered by a braid. The outer jacket 230 may electrically isolate the shield 215 from the armor 235*i,o* and be made from a seawater-resistant dielectric material, such as polyethylene or polyurethane. The armor may be made from one or more layers 235*i,o* of high strength material (i.e., tensile strength greater than or equal to one hundred, one fifty, or two hundred kpsi) to support the pod 20 so that the umbilical 200 may be used to launch and remove the pod 20 into/from the sea. The high strength material may be a metal or alloy and corrosion resistant, such as galvanized steel, aluminum, or a polymer, such as a para-aramid fiber. The armor may include two contra-helically wound layers 235*i,o* of wire, fiber, or strip.

Additionally, the umbilical 200 may include a sheath 225 disposed between the shield 215 and the outer jacket 230. The sheath 225 may be made from lubricative material, such as polytetrafluoroethylene (PTFE) or lead, and may be tape helically wound around the shield 215. If lead is used for the sheath 225, a layer of bedding 220 may insulate the shield 215 from the sheath and be made from the dielectric material. Additionally, a buffer 245 may be disposed between the armor layers 235*i,o*. The buffer 245 may be tape and may be made from the lubricative material. The cover 240 may be made from an abrasion resistant material, such as a polymer, such as polyisoprene or polyethylene.

FIG. 2B illustrates the control pod 20. The pod 20 may be connected to the LARS 70 by the umbilical 200. The pod 20 may include a frame 24, a cablehead 21, a PLC 22, one or more power converters, such as a motor converter 25 and an auxiliary converter 29, a DIX 26, an interface 28, and an HPU 30. The frame 24 may have a base, such as a mud mat or piles, for supporting the pod from the seafloor 2*f*. The pod components may each be connected to the frame 24 within the frame for protection. Alternatively, the tree 50 may have a receptacle for receiving the control pod 20. Alternatively, the pod 20 may be installed on the tree 50 or be an integral part of the tree and the pod may be deployed with the tree and the umbilical 200 subsequently connected to the pod.

The motor converter 25 may be configured to suit the particular type of the ESP motor 101 (FIG. 3A). The ESP motor 101 may be an induction motor, a switched reluctance motor (SRM) or a permanent magnet motor, such as a brushless DC motor (BLDG). The induction motor may be a two-pole, three-phase, squirrel-cage induction type and may run at a nominal speed of thirty-five hundred rpm at sixty Hz. The SRM motor may include a multi-lobed rotor made from a magnetic material and a multi-lobed stator. Each lobe of the stator may be wound and opposing lobes may be connected in series to define each phase. For example, the SRM motor may be three-phase (six stator lobes) and include a four-lobed rotor. The BLDC motor may be two pole and three phase. The BLDC motor may include the stator having the three phase winding, a permanent magnet rotor, and a rotor position sensor. The permanent magnet rotor may be made of one or more rare earth, ceramic, or cermet magnets. The rotor position sensor may be a Hall-effect sensor, a rotary encoder, or sensorless (i.e., measurement of back EMF in undriven coils by the motor controller).

The motor converter 25 may include a power supply 25*i,d* and a motor controller 25*c*. The power supply may include one or more DC/DC converters 25*d*, each converter including an inverter, a transformer, and a rectifier for converting the DC power signal into an AC power signal and reducing the voltage from medium to low. Each DC/DC converter 25*d* may be a single phase active bridge circuit as discussed and illustrated in US Pub. Pat. App. 2010/0206554, which is herein incorporated by reference in its entirety. The power supply may include multiple DC/DC converters 25*d* (only one shown) connected in series to gradually reduce the DC voltage from medium to low. For the SRM and BLDC motors, the low voltage DC signal may then be supplied to the motor controller 25*c*. For the induction motor, the power supply may further include a three-phase inverter 25*i* for receiving the low voltage DC power signal from the DC/DC converters 25*d* and outputting a three phase low voltage AC power signal to the motor controller 25*c*.

For the induction motor, the motor controller 25*c* may be a switchboard (i.e., logic circuit) for simple control of the motor 101 at a nominal speed or a variable speed drive (VSD) for complex control of the motor. The VSD controller may include a microprocessor for varying the motor speed to achieve an optimum for the given conditions. The VSD may also gradually or soft start the motor, thereby reducing start-up strain on the shaft and the power supply and minimizing impact of adverse well conditions.

For the SRM or BLDC motors, the motor controller 25*c* may receive the low voltage DC power signal from the power supply and sequentially switch phases of the motor, thereby supplying an output signal to drive the phases of the motor 101. The output signal may be stepped, trapezoidal, or sinusoidal. The BLDC motor controller may be in communication with the rotor position sensor and include a bank of transistors or thyristors and a chopper drive for complex control (i.e., variable speed drive and/or soft start capability). The SRM motor controller may include a logic circuit for simple control (i.e. predetermined speed) or a microprocessor for complex control (i.e., variable speed drive and/or soft start capability). The SRM motor controller may use one or two-phase excitation, be unipolar or bi-polar, and control the speed of the motor by controlling the switching frequency. The SRM motor controller may include an asymmetric bridge or half-bridge.

Figure 4:
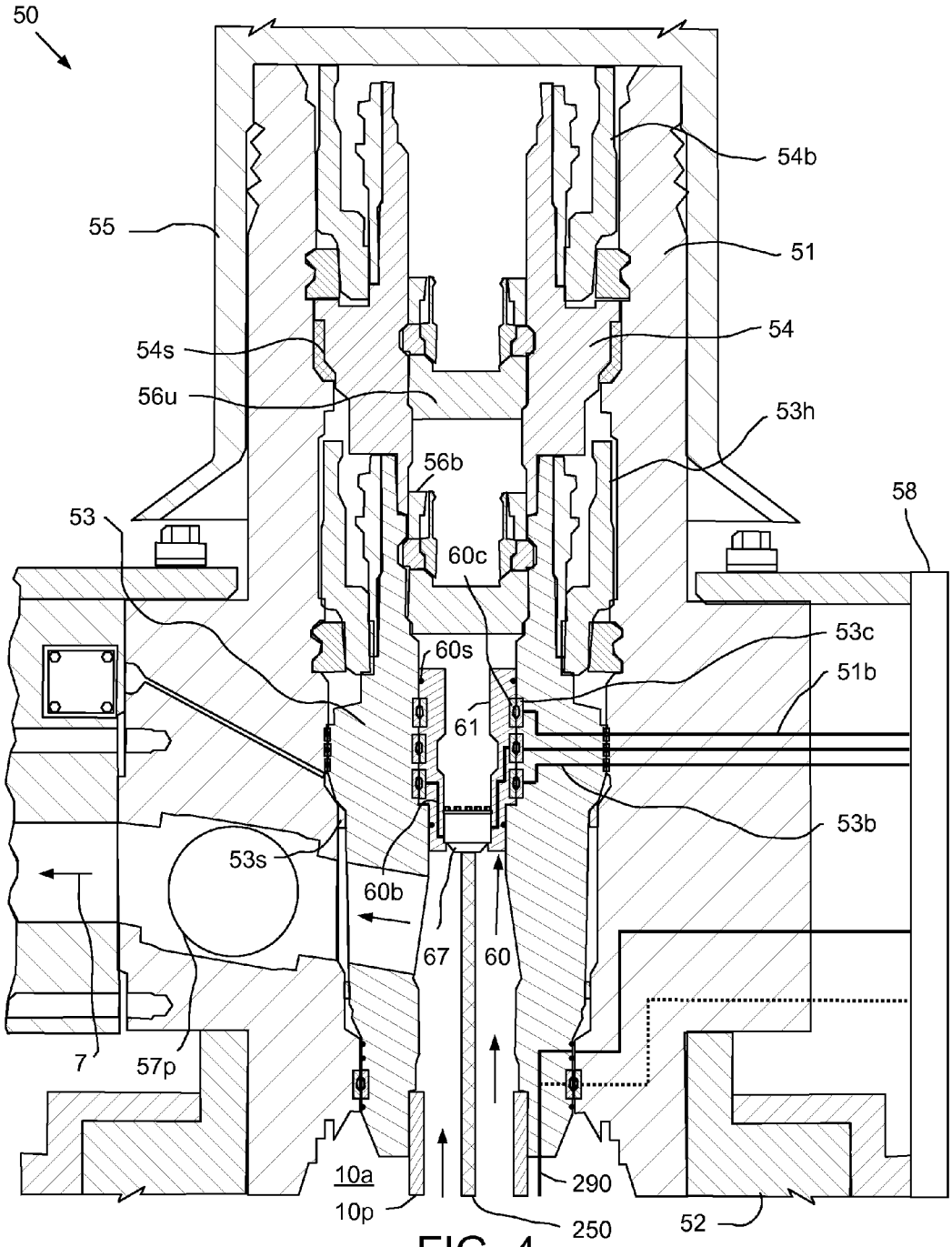
FIG. 4 illustrates a subsea tree of the ALS.

The motor controller 25*c* may output one or more (three shown) phase power signals to the interface 28 (i.e., junction plate) connected to the frame 24. The tree 50 may have a corresponding interface 58 (FIG. 4). The interfaces 28, 58 may be connected by jumpers (aka flying leads). The jumpers may be connected to the interfaces 28, 58 by a remotely operated vehicle (ROV, not shown) deployed from the support vessel. Alternatively, if the tree 50 has a pod receptacle, the interfaces may be include respective pins and sockets of a stab connector.

The pod PLC 22 may include a modem and multiplexer for receiving data signals from the LARS 70 via the DIX 26 and transmitting data signals to the LARS via the DIX. The pod PLC 22 may be in data communication with the DIX 26, the HPU 30, the motor controller 25*c*, and the interface 22. The pod PLC 22 may relay commands from the LARS 70 to the motor controller 25*c* regarding operation of the ESP 100. The pod PLC 22 may also relay feedback from the motor controller 25*c* to the LARS 70. The pod PLC 22 may also control operation of the HPU 30 in response to commands from the LARS 70. The pod PLC 22 may monitor operation of the HPU 30 and relay feedback from the HPU to the LARS 70. The HPU 30 may be similar to the LARS HPU, discussed above. The HPU 30 may be in hydraulic communication with the interface 28.

The auxiliary converter 29 may receive the medium voltage DC power signal from the umbilical 200 an convert the signal to an ultra-low voltage DC power signal for powering the PLC 22 and HPU 30. The auxiliary converter 29 may include one or more of the DC/DC converters, discussed above. Alternatively, the auxiliary converter 29 may connect to an output of the motor converter 25 instead of the DIX 26 or may be integrated with the motor converter. Alternatively, the HPU 30 may be AC powered.

FIG. 4 illustrates the subsea production tree 50. The tree 50 may be connected to the wellhead 10*h*, such as by a collet, mandrel, or clamp tree connector. The tree 50 may be vertical (not shown) or horizontal (shown). If the tree 50 is vertical, it may be installed after production tubing 10*p* is hung from the wellhead 10*h*. If the tree 50 is horizontal, the tree may be installed and then the production tubing 10*p* may be hung from the tree 50. The tree 50 may include fittings and valves to control production 7 from the wellbore 5 into a pipeline (not shown) which may lead to a production facility (not shown), such as a production vessel or platform.

The tree 50 may include a head 51, a wellhead connector 52, a tubing hanger 53, an internal cap 54, an external cap 55, an upper crown plug 56*u*, a lower crown plug 56*b*, a production valve 57*p*, one or more annulus valves (not shown), and a deployment cable hanger 60. Each of the components 51-54 may have a longitudinal bores extending therethrough. The tubing hanger 53 and head 51 may each have a lateral production passage formed through walls thereof for the flow of production fluid 7. The tubing hanger 53 may be disposed in the head bore. The tubing hanger 53 may support the production tubing 10*p*. The tubing hanger 53 may be fastened to the head by a latch 53*h*. The latch 53*h* may include one or more fasteners, such as dogs, an actuator, such as a cam sleeve. The cam sleeve may be operable to push the dogs outward into a profile formed in an inner surface of the tree head 51. The latch 53*h* may further include a collar for engagement with a running tool (not shown) for installing and removing the tubing hanger 53.

The tubing hanger 53 may be rotationally oriented and longitudinally aligned with the tree head 51. The tubing hanger 53 may further include seals 53*s* disposed above and below the production passage and engaging the tree head inner surface. The tubing hanger 53 may also have a number of auxiliary ports/conduits spaced circumferentially therearound. Each port/conduit may align with a corresponding port/conduit in the tree head 51 for hydraulic or electrical communication with the tubing hanger 53. The tubing hanger 53 may have an annular, partially spherical exterior portion that lands within a partially spherical surface formed in tree head 51.

The annulus 10*a* may communicate with an annulus passage (not shown) formed through and along the head 51 for and bypassing the seals 53*s*. The annulus passage may be accessed by removing internal tree cap 54. The tree cap 54 may be disposed in head bore above tubing hanger 53. The tree cap 54 may have a downward depending isolation sleeve received by an upper end of tubing hanger 53. Similar to the tubing hanger 53, the tree cap 54 may include a latch 54*b* fastening the tree cap to the head 51. The tree cap 54 may further include a seal 54*s* engaging the head inner surface. The production valve 57*p* may be disposed in the production passage and the annulus valves may be disposed in the annulus passage. Ports/conduits (not shown) may extend through the tree head 51 to the interface 58 for electrical or hydraulic operation of the valves 57*p*.

The upper crown plug 56*u* may be disposed in tree cap bore and the lower crown plug 56*b* may be disposed in the tubing hanger bore. Each crown plug 56*u,b* may have a body with a metal seal on its lower end. The metal seal may be a depending lip that engages a tapered inner surface of the respective cap and hanger. The body may have a plurality of windows which allow fasteners, such as dogs, to extend and retract. The dogs may be pushed outward by an actuator, such as a central cam. The cam may have a profile on its upper end for engagement by a running tool (not shown). The cam may move between a lower locked position and an upper position freeing dogs to retract. A retainer may secure to the upper end of body to retain the cam.

The cable hanger 60 may include a tubular body 61 having a bore therethrough, one or more leads 60*b*, a part of one or more (three shown) electrical couplings 60*c*, one or more seals 60*s*, and a cablehead 67. The cable head 67 may be connected to the cable hanger 60, such as by fastening (i.e., threaded or flanged connection). The cable hanger 60 may be connected to the tubing hanger 53 by resting on a shoulder formed in an inner surface of the tubing hanger. Alternatively or additionally, the cable hanger 60 may be fastened to the tubing hanger 53 by a latch (not shown).

Each lead 60*b* may be electrically connected to a respective conductor of the cable 250. Each lead 60*b* may extend from the cable head 67 to a respective coupling part 60*c* and be electrically connected to the cable conductor and the coupling part. Each coupling part 60*c* may include a contact, such as a ring, encased in insulation. The ring may be made from an electrically conductive material, such as aluminum, copper, aluminum alloy, copper alloy, or steel. The ring may also be split and biased outwardly. The insulation may be made from a dielectric material, such as a polymer (i.e., an elastomer or thermoplastic).

The tubing hanger 53 may include the other coupling parts 53*c* for receiving the respective cable hanger coupling parts 60*c*, thereby electrically connecting the cable hanger 60 and the tubing hanger 53. A lead 53*b* may be electrically connected to each tubing hanger coupling part 53*c* and extend through the tubing hanger 53 to a part of an electrical coupling electrically connecting the tubing hanger lead 53*b* with a tree head lead 51*b*. The tree head leads 51*b* may extend to the interface 58, thereby providing electrical communication between the pump controller 25*c* and the cable 250. The cable 250 may extend from the cable head 67 through the wellhead 10*h* and to a cable head 107 (FIG. 3A) of the ESP 100. Each of the cable heads 67, 107 may include a cable fastener (not shown), such as slips or a clamp for longitudinally connecting the cable 250.

Additionally, functions of the tree 50, such as operation of the production valve 57*p* and the annulus valves, may also be controlled by the pod 20. One or more additional jumpers may extend to the pod 20 and provide communication between the tree valves 57*p* and the HPU 30 (if the valve actuators are hydraulic) or the pod PLC 22 (if the valve actuators are electric). Alternatively, the tree 50 may have a separate controller and the pod 20 may interface with the tree controller. Additionally, the pod 20 may be a manifold serving a plurality of trees 50 and ESPs 100.

Figure 5A:
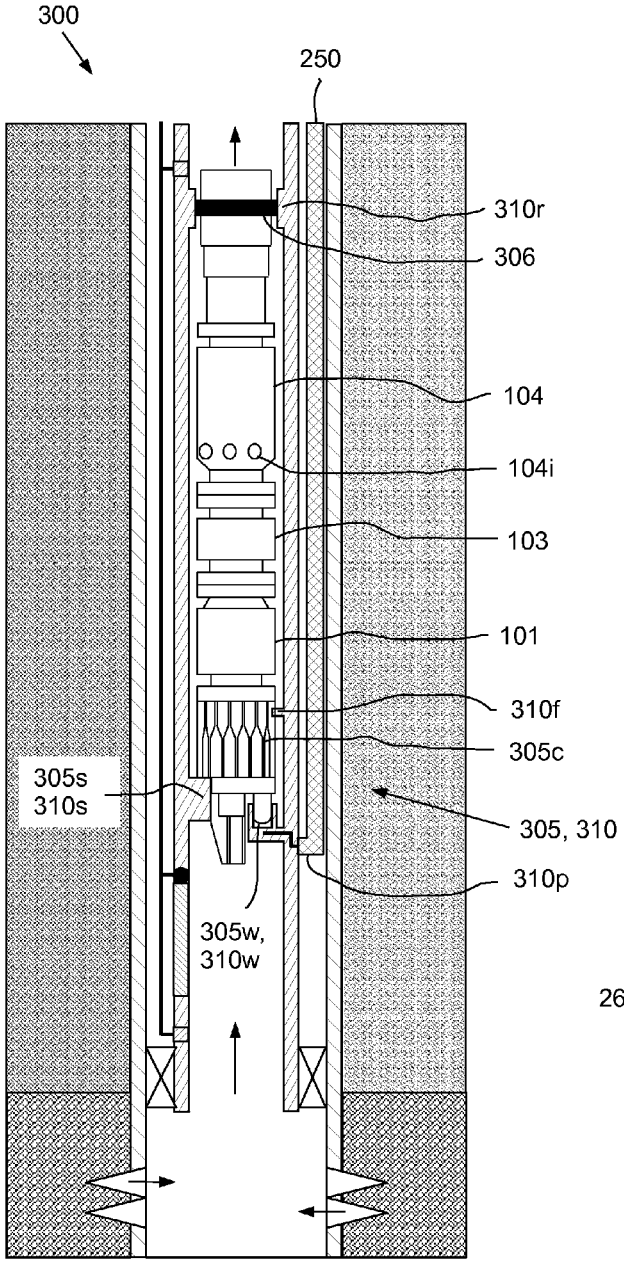
FIG. 5A illustrates an insert ESP of a subsea ALS, according to another embodiment of the present invention.
Figure 5B:
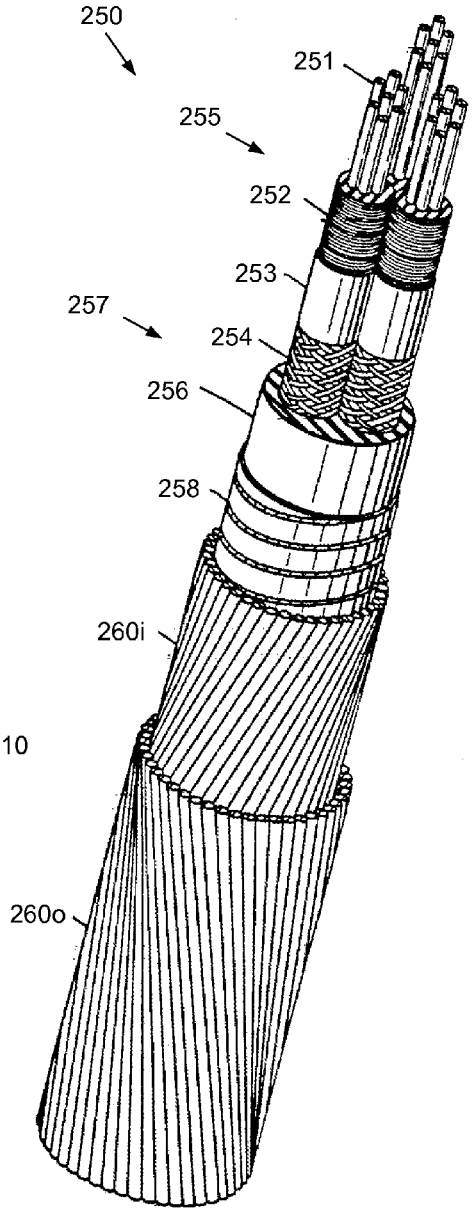
FIG. 5B illustrates a power/deployment cable of the ALS of FIG. 1 and/or the ALS of FIG. 5A.

FIG. 5B illustrates the deployment cable 250. The cable 250 may include a core 257 having one or more (three shown) wires 255 and a jacket 256, and one or more layers 260*i,o* of armor. Each wire 255 may include a conductor 251, a jacket 252, a sheath 253, and bedding 254. The conductors 251 may each be made from an electrically conductive material, such as aluminum, copper, or alloys thereof. The conductors 251 may each be solid or stranded. Each jacket 252 may electrically isolate a respective conductor 251 and be made from a dielectric material, such as a polymer (i.e., ethylene propylene diene monomer (EPDM)). Each sheath 253 may be made from lubricative material, such as polytetrafluoroethylene (PTFE) or lead, and may be tape helically wound around a respective wire jacket 252. Each bedding 254 may serve to protect and retain the respective sheath 253 during manufacture and may be made from a polymer, such as nylon. The core jacket 256 may protect and bind the wires 255 and be made from a polymer, such as EPDM or nitrile rubber.

The armor may be made from one or more layers 260*i,o* of high strength material (i.e., tensile strength greater than or equal to one hundred, one fifty, or two hundred kpsi) to support the ESP 100 so that the deployment cable 250 may be used to deploy and remove the ESP into/from the wellbore 5. The high strength material may be a metal or alloy and corrosion resistant, such as galvanized steel, aluminum, or a polymer, such as a para-aramid fiber. The armor may include two contra-helically wound layers 260*i,o* of wire, fiber, or strip. Additionally, a buffer (not shown) may be disposed between the armor layers 260*i,o*. The buffer may be tape and may be made from the lubricative material. Additionally, the cable 250 may further include a pressure containment layer 258 made from a material having sufficient strength to contain radial thermal expansion of the core 257 and wound to allow longitudinal expansion thereof.

FIG. 3A illustrates the ESP 100. The wellbore 5 has been drilled from the seafloor 2*f* into a hydrocarbon-bearing (i.e., crude oil and/or natural gas) reservoir 6. A string of casing 10*c* has been run into the wellbore 5 and set therein with cement (not shown). The casing 10*c* has been perforated 9 to provide to provide fluid communication between the reservoir 6 and a bore of the casing 10*c*. The casing 10*c* extends into the wellbore 5 from the wellhead 10*h*. A string of production tubing 10*p* extends from the tree 50 to the reservoir 6 to transport production fluid 7 from the reservoir 6 to the tree 50. A packer 8 has been set between the production tubing 10*p* and the casing 10*c* to isolate an annulus 10*a* formed between the production tubing and the casing from production fluid 7.

A subsurface safety valve (SSV) 3 may be assembled as part of the production tubing string 10*p*. The SSV 3 may include a housing, a valve member, a biasing member, and an actuator. The valve member may be a flapper operable between an open position and a closed position. The flapper may allow flow through the housing/production tubing bore in the open position and seal the housing/production tubing bore in the closed position. The flapper may operate as a check valve in the closed position i.e., preventing flow from the reservoir 6 to the wellhead 10*h* but allowing flow from the wellhead to the reservoir. Alternatively, the SSV 3 may be bidirectional. The actuator may be hydraulic and include a flow tube for engaging the flapper and forcing the flapper to the open position. The flow tube may also be a piston in communication with a hydraulic conduit of a control line 290 extending along an outer surface of the production tubing 10*p* to the wellhead 10*h*. Injection of hydraulic fluid into the conduit may move the flow tube against the biasing member (i.e., spring), thereby opening the flapper. The SSV 3 may also include a spring biasing the flapper toward the closed position. Relief of hydraulic pressure from the conduit may allow the springs to close the flapper.

The production tubing 10*p* may further include one or more sensors 4*u,b*. Each sensor 4*u,b* may be a pressure or pressure and temperature (PT) sensor. The sensors 4*u,b* may be located along the production tubing 10*p* so that the upper sensor 4*u* is in fluid communication with an outlet 106*o* of the ESP 100 and a lower sensor 4*b* is in fluid communication with an inlet 104*i* of the ESP 100. The sensors 4*u,b* may be in data communication with the pod PLC 22 via a data conduit of the control line 290, such as an electrical or optical cable. The data conduit may also provide power for the sensors. The control line 290 may also be connected to the tubing hanger 53 and the tubing hanger and tree head 51 may each include parts of respective data and hydraulic cables to provide communication with the tree interface 58. Jumpers may provide respective hydraulic and data communication with the pod 20.

The pod PLC 22 may receive measurements from the sensors 4*u,b* and relay the measurements to the LARS van 72 for monitoring operation of the ESP 100 by the van operator. The pod PLC 22 may also relay the measurements to the pump controller 25*c*. The pod HPU 30 may be in hydraulic communication with the SSV 3 for operation thereof. The van operator may adjust operation of the ESP 100 in response to monitoring the pressure sensors, such as adjusting a speed of the motor 101. Alternatively, any of the PLCs 22, 72*p* or motor controller 25*c* may adjust operation of the ESP autonomously. Additionally, the van operator or controllers 22, 72*p* may monitor the ESP 100 for adverse conditions, such as pump-off, gas lock, or abnormal power performance and take remedial action before damage to the pump 104 and/or motor 101 occurs.

The ESP 100 may include the electric motor 101, a seal section 103, a pump 104, an isolation device 106, a cablehead 107, and a flat cable 108. Housings of each of the ESP components may be longitudinally and torsionally connected, such as by flanged or threaded connections.

The cable 250 may be longitudinally coupled to the cablehead 107 by a shearable connection (not shown). The cable 250 may be sufficiently strong so that a margin exists between the ESP deployment weight and the strength of the cable. For example, if the deployment weight is ten thousand pounds, the shearable connection may be set to fail at fifteen thousand pounds and the cable may be rated to twenty thousand pounds. The cablehead 107 may further include a fishneck so that if the ESP 100 become trapped in the wellbore 5, such as by jamming of the isolation device 106 or buildup of sand, the cable 250 may be freed from rest of the components by operating the shearable connection and a fishing tool (not shown), such as an overshot, may be deployed to retrieve the ESP 100.

The cablehead 107 may also include leads (not shown) extending therethrough and through the isolation device 106. The leads may provide electrical communication between the conductors 251 of the cable 250 and conductors of the flat cable 108. The flat cable 108 may extend along the pump 104 and the seal section 103 to the motor 101. The flat cable 108 may have a low profile to account for limited annular clearance between the components 103, 104 and the production tubing 10*p*. The flat cable 108 may only need to support its own weight. The flat cable 108 may be armored by a metal or alloy. Alternatively, two or more, such as three, flat leads may be spaced around the pump 104 and the seal section 103 and connect the cable conductors 251 to the motor 101 instead of the flat cable 108. Alternatively, the motor 101 may be located above the seal section 103, the pump 104 and isolation device 106 may be located below the seal section, and the flat cable 108 may be omitted.

The motor 101 may be filled with a dielectric, thermally conductive liquid lubricant, such as motor oil. The motor 101 may be cooled by thermal communication with the production fluid 7. The motor 101 may include a thrust bearing (not shown) for supporting a drive shaft (not shown). In operation, the motor 101 may rotate the drive shaft, thereby driving a pump shaft (not shown) of the pump 104. The drive shaft may be directly connected to the pump shaft (no gearbox).

The seal section 103 may isolate the reservoir fluid 7 being pumped through the pump 104 from the lubricant in the motor 101 by equalizing the lubricant pressure with the pressure of the reservoir fluid 7. The seal section 103 may torsionally connect the drive shaft to the pump shaft. The seal section 103 may house a thrust bearing capable of supporting thrust load from the pump 104. The seal section 103 may be positive type or labyrinth type. The positive type may include an elastic, fluid-barrier bag to allow for thermal expansion of the motor lubricant during operation. The labyrinth type may include tube paths extending between a lubricant chamber and a reservoir fluid chamber providing limited fluid communication between the chambers.

The pump inlet 104*i* may be standard type, static gas separator type, or rotary gas separator type depending on the gas to oil ratio (GOR) of the production fluid 7. The standard type inlet may include a plurality of ports allowing reservoir fluid 7 to enter a lower or first stage of the pump 104. The standard inlet may include a screen to filter particulates from the reservoir fluid 7. The static gas separator type may include a reverse-flow path to separate a gas portion of the reservoir fluid 7 from a liquid portion of the reservoir fluid 7.

The isolation device 106 may include a packer, an anchor, and an actuator. The actuator may be operated mechanically by articulation of the cable 250, electrically by power from the cable, or hydraulically by discharge pressure from the pump 104. The packer may be made from a polymer, such as a thermoplastic, elastomer, or copolymer, such as rubber, polyurethane, or PTFE. The isolation device 106 may have a bore formed therethrough in fluid communication with the pump outlet and have one or more discharge ports 106*o* formed above the packer for discharging the pressurized reservoir fluid 7 into the production tubing 10*p*. Once the ESP 100 has reached deployment depth, the isolation device actuator may be operated, thereby setting the anchor and expanding the packer against the production tubing 10*p*, isolating the pump inlet 104*i* from the pump outlet, and torsionally connecting the ESP 100 to the production tubing 10*p*. The anchor may also longitudinally support the ESP 100.

Additionally, the isolation device 106 may include a bypass vent (not shown) for releasing gas separated by the pump inlet 104*i* that may collect below the isolation device and preventing gas lock of the pump 104. A pressure relief valve (not shown) may be disposed in the bypass vent. Additionally, a downhole tractor (not shown) may be integrated into the cable 250 to facilitate the delivery of the ESP 100, especially for highly deviated wells, such as those having an inclination of more than forty-five degrees or dogleg severity in excess of five degrees per one hundred feet. The drive and wheels of the tractor may be collapsed against the cable and deployed when required by a signal from the surface.

The pump 104 may be centrifugal or positive displacement. The centrifugal pump may be a radial flow or mixed axial/radial flow. The positive displacement pump may be progressive cavity. The pump 104 may include one or more stages (not shown). Each stage of the centrifugal pump may include an impeller and a diffuser. The impeller may be torsionally and longitudinally connected to the pump shaft, such as by a key. The diffuser may be longitudinally and torsionally connected to a housing of the pump, such as by compression between a head and base screwed into the housing. Rotation of the impeller may impart velocity to the reservoir fluid 7 and flow through the stationary diffuser may convert a portion of the velocity into pressure. The pump 104 may deliver the pressurized reservoir fluid 7 to the isolation device bore.

Alternatively, the pump 104 may be a high speed compact pump discussed and illustrated at FIGS. 1C and 1D of U.S. patent application Ser. No. 12/794,547, filed Jun. 4, 2010, which is herein incorporated by reference in its entirety. High speed may be greater than or equal to ten thousand, fifteen thousand, or twenty thousand revolutions per minute (RPM). The compact pump may include one or more stages, such as three. Each stage may include a housing, a mandrel, and an annular passage formed between the housing and the mandrel. The mandrel may be disposed in the housing. The mandrel may include a rotor, one or more helicoidal rotor vanes, a diffuser, and one or more diffuser vanes. The rotor may include a shaft portion and an impeller portion. The rotor may be supported from the diffuser for rotation relative to the diffuser and the housing by a hydrodynamic radial bearing formed between an inner surface of the diffuser and an outer surface of the shaft portion. The rotor vanes may interweave to form a pumping cavity therebetween. A pitch of the pumping cavity may increase from an inlet of the stage to an outlet of the stage. The rotor may be longitudinally and torsionally connected to the motor drive shaft and be rotated by operation of the motor. As the rotor is rotated, the production fluid 7 may be pumped along the cavity from the inlet toward the outlet. The annular passage may have a nozzle portion, a throat portion, and a diffuser portion from the inlet to the outlet of each stage, thereby forming a Venturi.

Additionally, the ESP 100 may further include a sensor sub (not shown). The sensor sub may be employed in addition to or instead of the sensors 4*u,b*. The sensor sub may include a controller, a modem, a diplexer, and one or more sensors (not shown) distributed throughout the ESP 100. The controller may transmit data from the sensors to the motor controller via conductors 251 of the cable 250. Alternatively, the cable 250 may further include a data conduit, such as data wires or optical fiber, for transmitting the data. A PT sensor may be in fluid communication with the reservoir fluid 7 entering the pump inlet 104*i*. A GOR sensor may also be in fluid communication with the reservoir fluid 7 entering the pump inlet 104*i*. A second PT sensor may be in fluid communication with the reservoir fluid 7 discharged from the pump outlet/ports 1060. A temperature sensor (or PT sensor) may be in fluid communication with the lubricant to ensure that the motor 101 is being sufficiently cooled. A voltage meter and current (VAMP) sensor may be in electrical communication with the cable 250 to monitor power loss from the cable. Further, one or more vibration sensors may monitor operation of the motor 101, the pump 104, and/or the seal section 103. A flow meter may be in fluid communication with the pump outlet for monitoring a flow rate of the pump 104. Alternatively, the tree 50 may include a flow meter (not shown) for measuring a flow rate of the pump 104 and the tree flow meter may be in data communication with the control pod 20.

The ESP 100 may be retrieved periodically for maintenance or replacement. To retrieve the ESP 100, a lubricator (not shown, see '547 application), may be deployed and landed on to the tree 50 by a support vessel. The lubricator may be used to retrieve the ESP 100 to the vessel and redeploy a repaired/replacement ESP riserlessly and without killing the reservoir 6. Alternatively, a mobile offshore drilling unit (MODU) may be used to retrieve and redeploy a repaired/replacement ESP using a riser and a lubricator. For either approach, a running tool may be deployed using wireline and connect to a profile formed in an inner surface of the cable hanger 60. The cable hanger 60 may then be lifted from the tree 50 and the cable 250 may carry the ESP 100 along therewith. The repaired/replacement ESP may also be deployed in a similar fashion.

FIG. 5A illustrates an insert ESP 300 of a subsea ALS, according to another embodiment of the present invention. The ESP 300 may be similar to the ESP 100 except that instead of being deployed by the cable 250, the cable 250 is deployed with the production tubing 10*p* and the production tubing includes a dock 310 for receiving a lander 305 of the ESP 300. The dock 310 may include a penetrator 310*p* for receiving an end of the cable 250. The cable 250 may be fastened along an outer surface of the production tubing 10*p* at regular intervals, such as by clamps or bands (not shown). Each of the lander 305 and dock 310 may include part, such as a pin or box, of a wet mateable connector 305*w*, 310*w*. The wet matable connector 305*w*, 310*w* may include one or more pairs, such as three, of pins and boxes for each conductor 251 of the cable 250 and phase of the motor 101. The lander 305 may have a flow passage formed therethrough for the intake of production fluid 7 and leads providing electrical communication between the pins 305*w* and the motor 101. A suitable wet matable connector is discussed and illustrated U.S. Pat. Pub. No. 2011/0024104, which is herein incorporated by reference in its entirety.

Each of the lander 305 and dock 310 may also include part of an auto-orienter 305*c*, 310*f*. The auto-orienter may include a cam 305*c* and one or more followers 310*f*. As the ESP 300 is lowered into the dock, the auto-orienter may rotate the ESP to align the pins 305*w* with the respective boxes 310*w*. Each of the lander 305 and dock 310 may further include one or more parts, such as splines 305*s*, 310*s*, of a torque profile. Engagement of the splines 305*s*, 310*s* may torsionally connect the ESP 300 to the production tubing 310. A landing shoulder may be formed at a top of each of the splines 305*s* to longitudinally support the ESP 300 in the production tubing 10*p*. The ESP 300 may include the isolation device 306 instead of the isolation device 106. The isolation device 306 may have one or more fixed seals received by a polished bore receptacle 310*r* of the dock 310, thereby isolating discharge ports (not shown) of the isolation device from the pump inlet 104*i*. The isolation device 306 may further include a latch (not shown) operable to engage a latch profile (not shown) of the dock 310, thereby longitudinally connecting the ESP 300 to the production tubing 10*p*.

The isolation device 306 may further include a fishing profile, such as a neck, or inner profile, for engagement with a running tool (not shown). The running tool may be deployed as a bottomhole assembly (BHA) of a wireline or coiled tubing workstring to retrieve the ESP 300 for maintenance/replacement and to deploy a repaired/replacement ESP. The ESP 300 may be initially deployed with the production tubing 10*p* or using the running tool. The running tool may include a latch for engaging the fishing neck/inner profile. The fishing neck/inner profile may be operably coupled to the isolation device 306 to release the isolation device latch in response to articulation of the workstring. When deploying the ESP 300, the isolation device latch may set by articulation of the workstring. The running tool may further include a seal for engaging an inner surface of the production tubing so pumping may be used to assist deployment of the running tool. A suitable running tool is discussed and illustrated in U.S. Pat. No. 6,415,869, which is herein incorporated by reference in its entirety.

Additionally, the ESP 300 may further include a sensor sub as discussed above for the ESP 100. Alternatively, a tubing deployed ESP (not shown) may be used with the alternative ALS instead of the insert ESP 300. Alternatively, the cable deployed ESP 100 may include the isolation device 306 instead of the isolation device 106.

Figure 6:
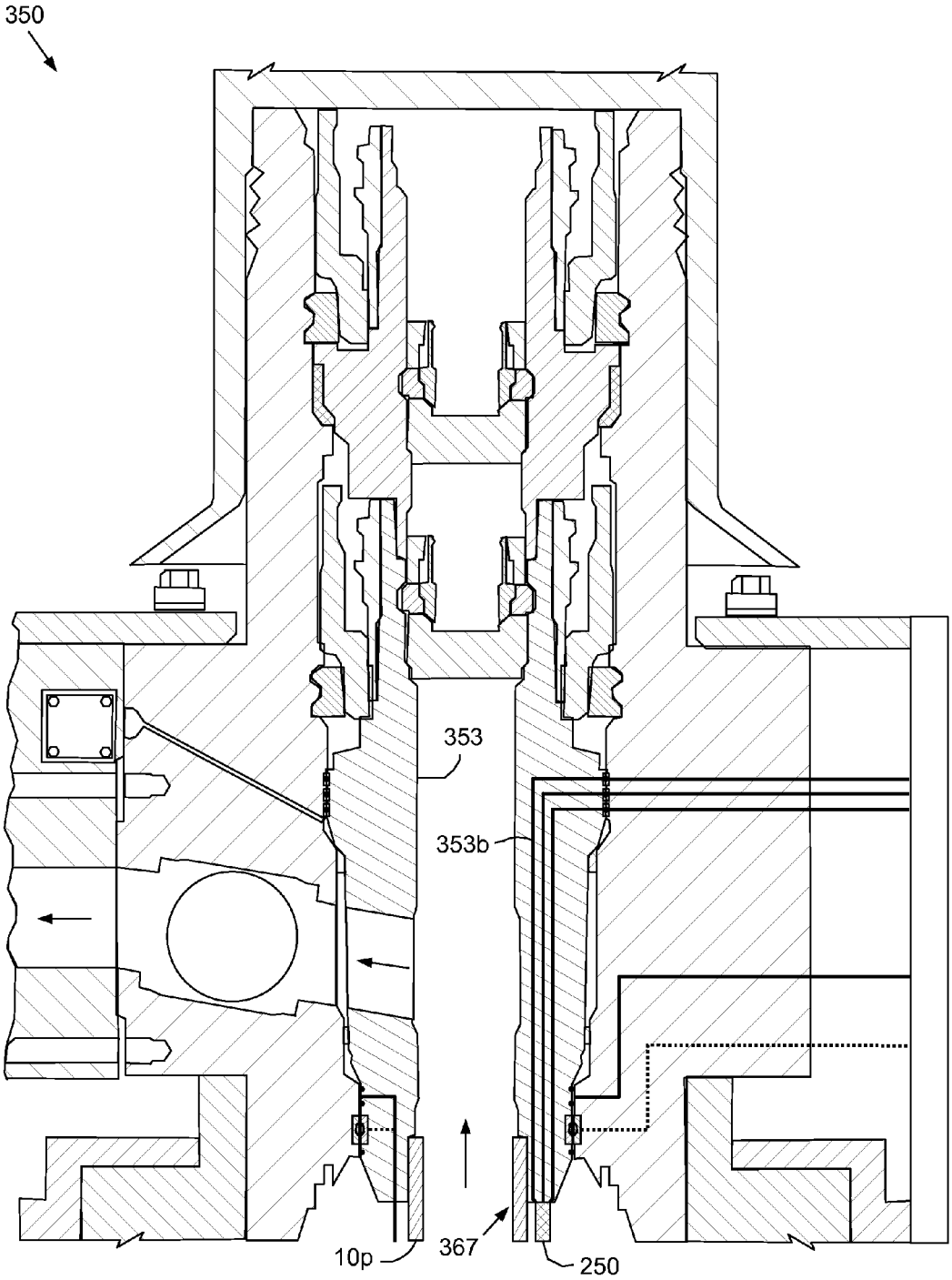
FIG. 6 illustrates a subsea tree of the alternative ALS.

FIG. 6 illustrates a subsea production tree 350 of the alternative ALS. Instead of the cable hanger 60, the tubing hanger 353 may include a cablehead 367 for receiving the cable 250 and providing electrical communication between the cable conductors 251 and respective leads 353*b*.

While the foregoing is directed to embodiments of the present invention, other and further embodiments of the invention may be devised without departing from the basic scope thereof, and the scope thereof is determined by the claims that follow.

The invention claimed is:

1. A method of operating an electric submersible pump (ESP) in a subsea wellbore, comprising:

supplying a direct current (DC) power signal from a dry location to a subsea control pod;

converting the DC power signal to a three phase alternating current (AC) power signal by the control pod; and supplying the three phase AC power signal from the control pod, through a subsea production tree, into the subsea wellbore, and to the ESP, wherein:

the ESP pumps production fluid from a reservoir intersected by the wellbore to the subsea tree via production tubing, and the three phase AC power signal is routed laterally through the subsea tree such that crown plugs of the subsea tree remain in place during pumping of the production fluid.

2. The method of claim 1, wherein:

the ESP comprises a cablehead connected to a deployment cable, the deployment cable extends to the tree via a bore of the production tubing, and the deployment cable conducts the AC power signal to the ESP.

3. The method of claim 1, wherein a power cable extends along an outer surface of the production tubing and conducts the AC power signal to the ESP.

4. The method of claim 3, wherein the production tubing comprises a dock connecting the ESP to the power cable.

5. The method of claim 1, wherein:

the production tubing comprises a subsurface safety valve (SSV), the pod comprises a hydraulic power unit (HPU), and the method further comprises operating the SSV using the HPU.

6. The method of claim 1, wherein:

the production tubing comprises an upper pressure sensor in communication with an outlet of the ESP and a lower pressure sensor in communication with an inlet of the ESP, and the method further comprises:

monitoring the pressure sensors, and adjusting a speed of the ESP in response to monitoring.

7. The method of claim 1, wherein the DC power signal is medium voltage and the AC power signal is low voltage.

8. The method of claim 1, wherein:

the DC power signal is supplied to the pod via an umbilical, and the method further comprises diplexing a data signal on the umbilical with the DC power signal.

9. The method of claim 8, further comprising launching the pod using the umbilical.

10. An artificial lift system (ALS) for a subsea wellbore, comprising:

a subsea control pod comprising:

a cablehead for receiving an umbilical;

a diplexer for separating a composite signal received by the umbilical into a DC power signal and a data signal;

a power converter, comprising:

a power supply for reducing voltage of the DC power signal from medium to low; and a motor controller for receiving an output signal of the power supply and supplying a three phase power signal to an electric submersible pump (ESP);

a subsea interface for connection to a subsea production tree; and the subsea tree comprising:

an interface for connection to the interface of the control pod;

upper and lower crown plugs closing a bore of the tree;

a head; and leads extending from the tree interface and laterally through the head for supplying the three phase power signal to the ESP.

11. The ALS of claim 10, wherein the power supply further comprises a three phase inverter.

12. The ALS of claim 10, wherein the motor controller is a variable speed drive.

13. The ALS of claim 10, further comprising a programmable logic controller (PLC) for receiving measurements from downhole pressure sensors and transmitting the measurements to the diplexer for transmission through the umbilical.

14. The ALS of claim 10, further comprising a hydraulic power unit.

15. The ALS of claim 10, further comprising a frame containing the diplexer and the power converter, wherein:

the cablehead is connected to the frame, and the cablehead is capable of supporting the pod for deployment using the umbilical.

16. The ALS of claim 10, further comprising:

the ESP in fluid communication with the tree via production tubing;

a power or deployment cable in electrical communication with the tree and the ESP;

the umbilical; and a launch and recovery system connected to the umbilical.

* * * * *